US009702230B2

(12) United States Patent
Ruby

(10) Patent No.: US 9,702,230 B2
(45) Date of Patent: Jul. 11, 2017

(54) DOWNHOLE PERFORATOR GUN BYPASS TOOL

(71) Applicant: Thru Tubing Solutions, Inc., Oklahoma City, OK (US)

(72) Inventor: James Ruby, Galveston, TX (US)

(73) Assignee: Thru Tubing Solutions, Inc., Oklahoma City, OK (US)

( * ) Notice: Subject to any disclaimer, the term of this patent is extended or adjusted under 35 U.S.C. 154(b) by 328 days.

(21) Appl. No.: 14/615,265

(22) Filed: Feb. 5, 2015

(65) Prior Publication Data

US 2015/0218910 A1 Aug. 6, 2015

Related U.S. Application Data

(60) Provisional application No. 61/936,206, filed on Feb. 5, 2014.

(51) Int. Cl.
*E21B 29/02* (2006.01)
*E21B 43/116* (2006.01)

(52) U.S. Cl.
CPC ..... *E21B 43/116* (2013.01)

(58) Field of Classification Search
CPC ..... E21B 29/02; E21B 43/116; E21B 43/117
USPC ..... 166/296, 299, 55, 55.2, 63; 89/1.15, 89/1.151
See application file for complete search history.

(56) References Cited

U.S. PATENT DOCUMENTS 4,901,802 A * 2/1990 George ..... E21B 43/116 102/275
5,067,568 A * 11/1991 Yates, Jr. ..... E21B 43/117 166/55
5,103,912 A * 4/1992 Flint ..... E21B 23/00 166/297
6,123,152 A * 9/2000 Edwards ..... E21B 33/068 166/319
6,491,098 B1 * 12/2002 Dallas ..... E21B 43/116 166/297
6,536,524 B1 * 3/2003 Snider ..... E21B 23/00 166/297
6,719,061 B2 * 4/2004 Muller ..... E21B 33/068 166/242.6
6,962,203 B2 * 11/2005 Funchess ..... E21B 43/08 166/263
7,650,947 B2 * 1/2010 Henke ..... E21B 10/00 166/242.6
2004/0238167 A1 12/2004 Pinto et al.
2009/0032255 A1 2/2009 Surjaatmadja et al.
2009/0242198 A1 10/2009 Evans et al.
(Continued)

OTHER PUBLICATIONS

International Search Report and Written Opinion; PCT/US2015/014666; dated May 14, 2015; 14 pages.

*Primary Examiner* — Kenneth L Thompson
(74) *Attorney, Agent, or Firm* — Hall Estill Law Firm

(57) ABSTRACT

The present invention is for a downhole tool having a perforator gun portion disposed within a housing of the downhole tool for perforating an oil and gas formation. The downhole tool also includes a bypass passageway for directing fluid past the perforator gun portion in the downhole tool to permit fluid flowing into the downhole tool to flow out of the downhole tool to facilitate an oil and gas operation. Furthermore, the downhole tool is used in a method of performing the oil and gas operation in a wellbore by pumping fluid through the downhole tool.

17 Claims, 7 Drawing Sheets

(56) References Cited

U.S. PATENT DOCUMENTS

| | | | | |
|---|---|---|---|---|
| 2010/0089587 | A1* | 4/2010 | Stout | E21B 23/04 166/319 |
| 2010/0236781 | A1* | 9/2010 | Mytopher | E21B 34/063 166/297 |
| 2011/0042100 | A1 | 2/2011 | O'Neal et al. | |
| 2011/0108263 | A1* | 5/2011 | Hales | E21B 43/1195 166/55.1 |
| 2012/0031615 | A1 | 2/2012 | Connell et al. | |
| 2013/0098616 | A1* | 4/2013 | Ross | E21B 43/11852 166/297 |

* cited by examiner

DOWNHOLE PERFORATOR GUN BYPASS TOOL

CROSS-REFERENCE TO RELATED APPLICATIONS

The present application is a conversion of U.S. Provisional Application having U.S. Ser. No. 61/936,206, filed Feb. 5, 2014, which claims the benefit under 35 U.S.C. 119(e). The disclosure of which is hereby expressly incorporated herein by reference.

STATEMENT REGARDING FEDERALLY SPONSORED RESEARCH OR DEVELOPMENT

Not applicable.

BACKGROUND OF THE DISCLOSURE

1. Field of the Invention

The present disclosure relates to a downhole tool having a fluid directing apparatus to divert fluid around a perforator gun portion disposed in the downhole tool.

2. Description of the Related Art

Traditionally, when perforator guns are used to perforate a formation the perforator guns are positioned in the well. The perforator gun is fired and then the perforator gun has to be removed.

Accordingly, there is a need for a downhole tool that includes a perforator gun portion and various other components to permit a bottom hole assembly (BHA) that includes a perforator gun to do more than just perforate the formation.

SUMMARY OF THE DISCLOSURE

The present disclosure is directed to a downhole tool having a perforator gun portion disposed within a housing of the downhole tool for perforating an oil and gas formation. The downhole tool also includes a bypass passageway for directing fluid past the perforator gun portion in the downhole tool to permit fluid flowing into the downhole tool to flow out of the downhole tool to facilitate an oil and gas operation.

The present disclosure is also directed toward a method of performing an oil and gas operation in a wellbore by pumping fluid through the downhole tool.

DETAILED DESCRIPTION OF THE DISCLOSURE

Figure 1A:
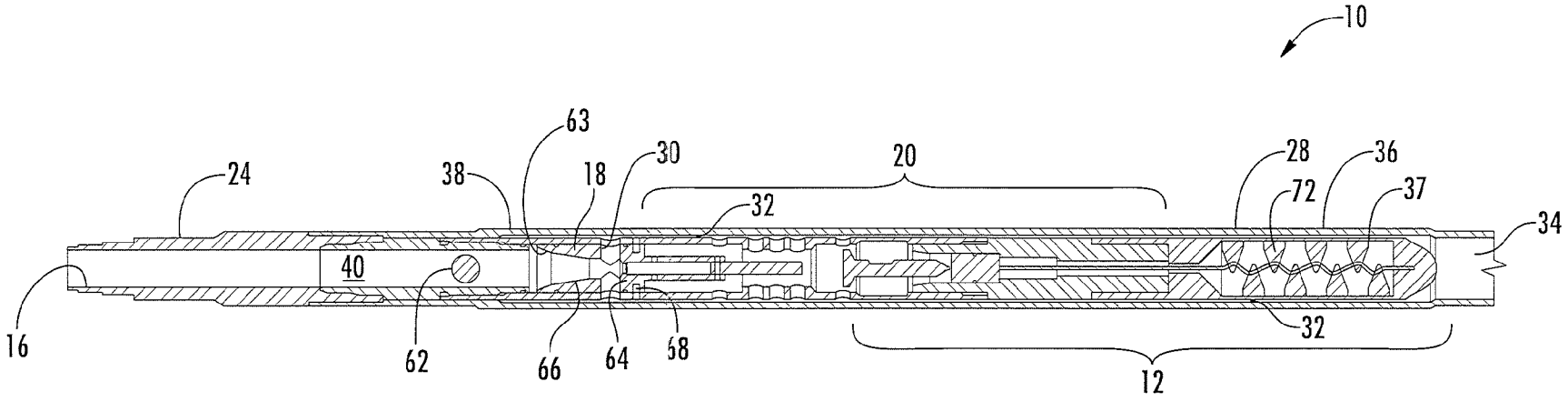
FIG. 1A is a side elevation view of a portion of a downhole tool constructed in accordance with the present disclosure.

The present disclosure relates to a downhole tool 10 that includes a perforator gun portion 12 that can be run into a wellbore with a motor section 14. Thus, other operations, such as a cleanout operation, could be accomplished with a tubing-conveyed perforation operation in a single run into the wellbore. In addition to the perforator gun portion 12 and the motor section 14 as shown in FIGS. 1A-2C, the downhole tool 10 includes an inlet 16 for receiving fluid into the tool 10, a fluid directing apparatus 18 for providing a bypass passageway for fluid to bypass the perforator gun portion 12, and a firing assembly 20 for actuating the perforator gun portion 12.

The downhole tool 10 can also include an outlet 22 for allowing fluid to exit the downhole tool 10, a top sub 24 for allowing the downhole tool 10 to be attached to other tools disposed above (or uphole from) the downhole tool 10 in a bottom hole assembly (BHA) and a bottom sub 26 for allowing the downhole tool 10 to be connected to other tools disposed below (or dowhole from) the downhole tool 10 in the BHA. The downhole tool 10 has a housing 28 that extends from the top sub 24 to the bottom sub 26. The housing 28 of the downhole tool 10 can be made up of various portions that are combined to create the housing 28 of the downhole tool 10. It should be understood and appreciated that inlet 16 is disposed in the top sub 24 and the outlet 18 is disposed in the bottom sub 26 of the downhole tool 10.

Figure 1B:
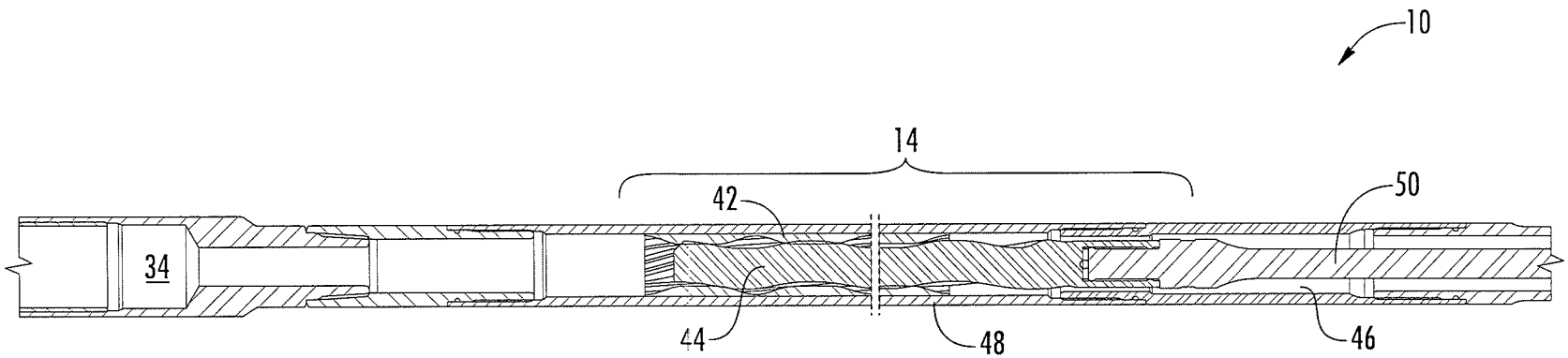
FIG. 1B is a side elevation view of another portion of the downhole tool constructed in accordance with the present disclosure.
Figure 1C:
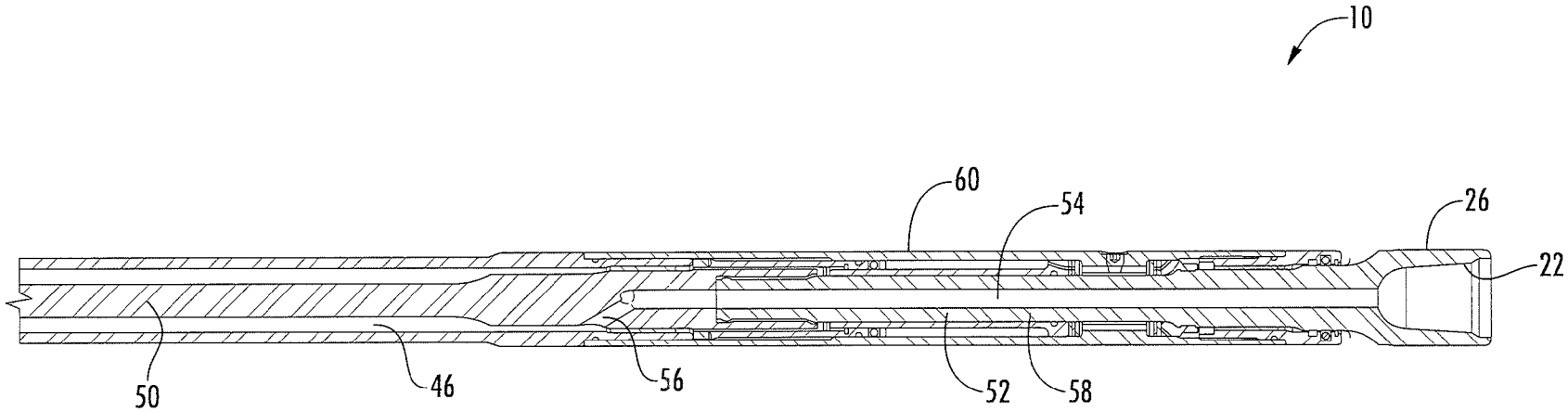
FIG. 1C is a side elevation view of another portion of the downhole tool constructed in accordance with the present disclosure.

In one embodiment of the present disclosure shown in more detail in FIGS. 1A-1C, the fluid directing apparatus 18 directs fluid through at least one port 30 into an annulus area 32 (or bypass passageway) where the fluid can bypass the perforator gun portion 12 and flow into a collection area 34 prior to entering the motor section 14 of the downhole tool 10. A portion of the annulus area 32 is created by the space existing between a perforator portion 36 of the housing 28 of the downhole tool 10 and a perforator gun housing 37 disposed within the perforator portion 36 of the housing 28. In this embodiment, the annulus area 32 is open, or remains free of obstructions, for the entire length of the perforator gun housing 37 and for the entire circumference of the annulus area 32 around the perforator gun housing 37. The annulus area 32 can also exist between the firing assembly 20 of the downhole tool 10 and an upper portion 38 of the housing 28.

In a further embodiment, the at least one port 30 can be disposed in any part of the downhole tool 10 or uphole from firing assembly 20 to allow fluid to pass from the inlet 16 into a fluid passageway 40 disposed in the upper portion 38 of the housing 28 into any portion of the annulus area 32. In one embodiment, the at least one port 30 extends in the radial direction through the fluid directing apparatus 18.

Figure 2A:
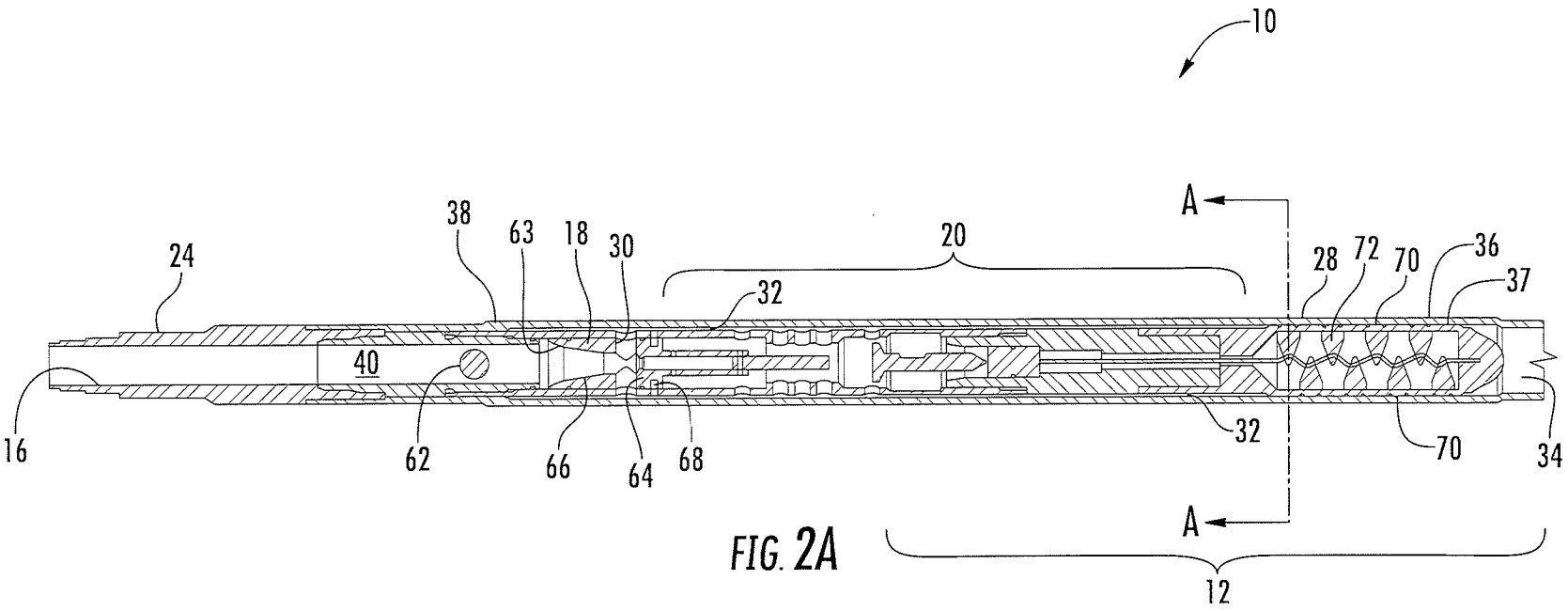
FIG. 2A is a side elevation view of a portion of another embodiment of a downhole tool constructed in accordance with the present disclosure.
Figure 2B:
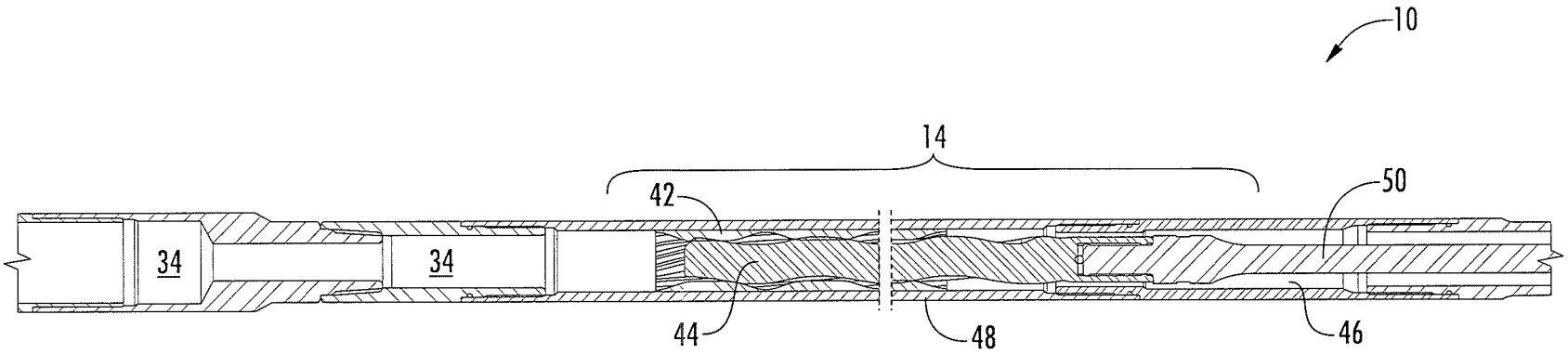
FIG. 2B is a side elevation view of another portion of the downhole tool constructed in accordance with the present disclosure.
Figure 2C:
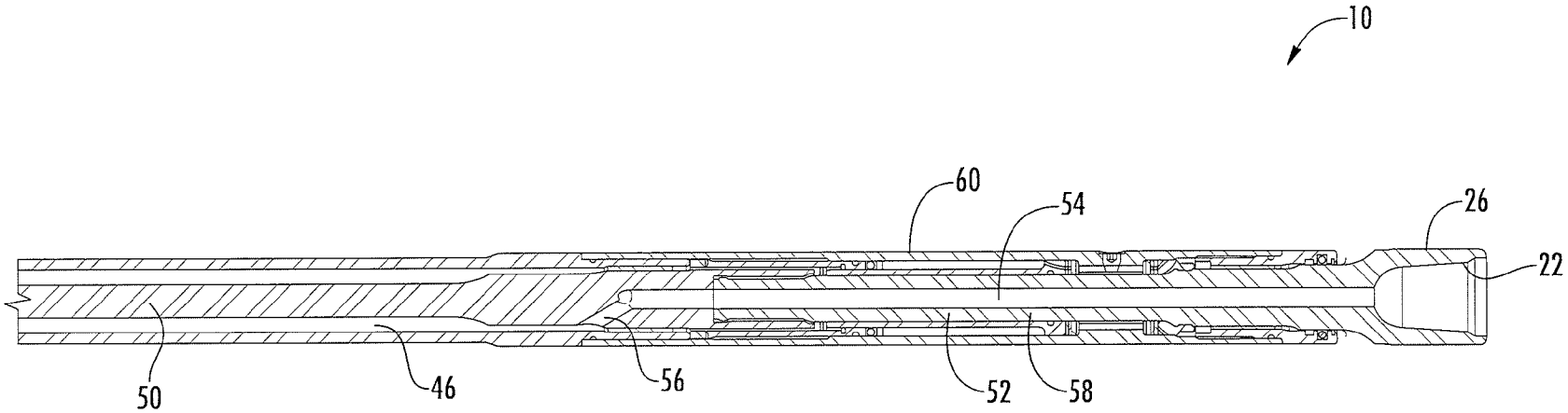
FIG. 2C is a side elevation view of another portion of the downhole tool constructed in accordance with the present disclosure.

Once fluid has flowed from the annulus area 32 and into the collection area 34, fluid can then flow from the collection area 34 into the motor section 14 seen primarily in FIGS. 1B and 2B. The motor section 14 can be any type of motor known in the art for driving the rotation of a rotor and/or drill bit. For example, the motor section 14 can include a stator 42 and rotor 44 wherein the rotor 44 rotates within the stator 42 as fluid passes between the stator 42 and the rotor 44. The fluid flows from between the rotor 44 and stator 42 into a second annulus area 46 disposed between a motor section 48 of the housing 28 of the downhole tool 10 and a rotation element 50. The rotation element 50 connects the rotor 44 to a passageway housing 52 and transfers the rotation of the rotor 44 to the passageway housing 52. Fluid flows from the second annulus area 46 to a passageway 54 disposed in the passageway housing 52 via a port 56 disposed in a sidewall 58 of the passageway housing 52. The fluid can then flow through the passageway 54 disposed in the passageway housing 52 and out of the outlet 22 of the downhole tool 10 to other tools disposed below the downhole tool 10 in the BHA, such as a drill bit.

In one embodiment, the bottom sub 26 can be combined with the passageway housing 52 and be rotatably disposed in a lower portion 50 of the housing 28. The lower portion 60 of the housing 28 can include seals to prevent fluid from flowing from the second annulus area 46 between the passageway housing 52 and the lower portion 60 of the housing 28 and out of the downhole tool 10. The lower portion 60 of the housing 28 can also include bearings and any other components necessary to facilitate the rotation of the passageway housing 52 in the lower portion 60 of the housing 28.

The firing assembly 20 can be any type of assembly known in the art for actuating a perforator gun. Examples of elements included in the firing assembly 20 can include, but are not limited to detonator chords, firing pins, pyrotechnical devices, and the like.

When it is no longer desirable to have fluid bypass the perforator gun portion 12 and flow through the motor section 14, a fluid blocking element 62 can be passed into the downhole tool 10 which blocks fluid from passing through the at least one port 30 of the fluid directing apparatus 18 by engaging a seat 63 disposed in the fluid directing apparatus 18. Once fluid is prevented from flowing through the at least one port 30 and into the annulus area 32, actuation of the firing assembly 20 can be initiated. In one example, the fluid directing apparatus 18 can be disposed in a slidable element 64 slidably disposed in a fluid directing body 66 disposed in the downhole tool 10. Once fluid is blocked via the fluid blocking element 62, shear pins 68 can be sheared and the slidable element 64 engages the firing assembly 20 to cause the actuation of the firing assembly 20.

Figure 3:
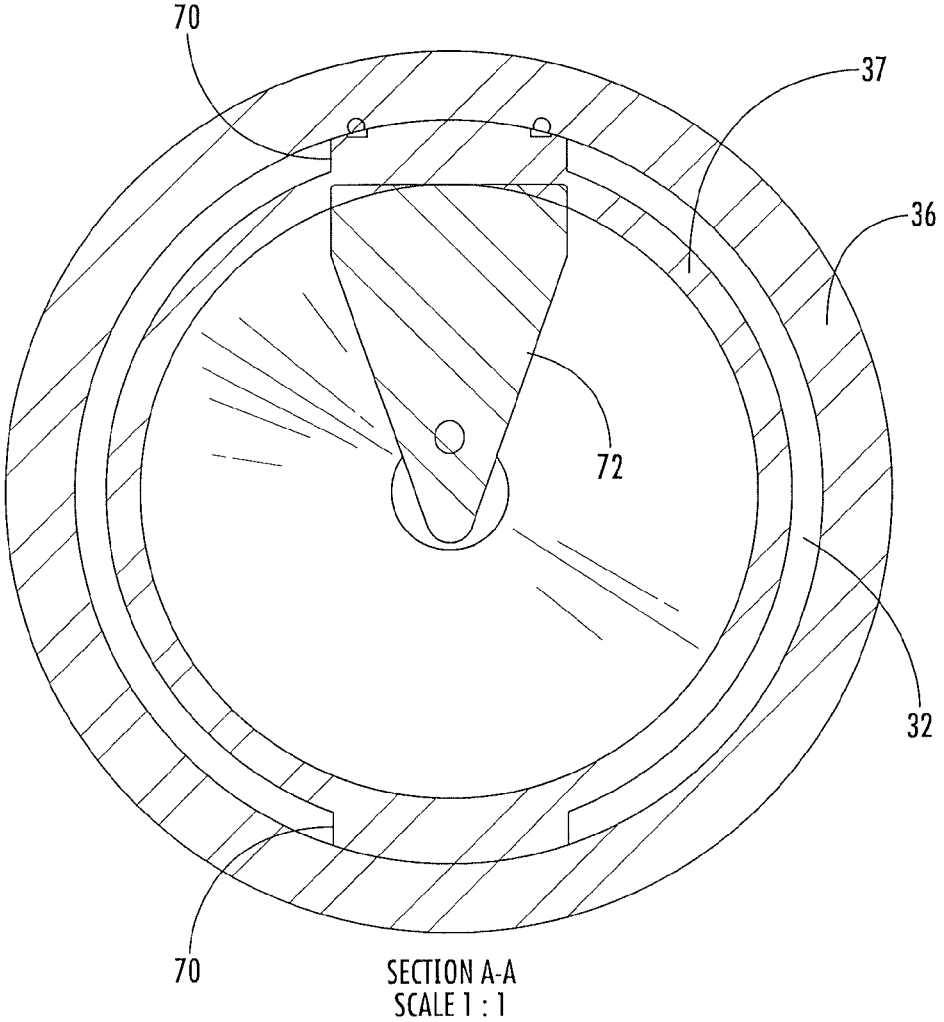
FIG. 3 is a cross-sectional view of a portion of the downhole tool across line A-A shown in FIG. 4A.

In another embodiment of the present disclosure, shown in FIGS. 2A-2C and 3, the annulus area 32 is not completely open and unobstructed between the perforator portion 36 of the housing 28 of the downhole tool 10 and the perforator gun housing 37 disposed within the perforator portion 36 of the housing 28. In this embodiment, only a portion of the annulus area 32 is open at a given cross-section of the downhole tool 10 along the length of the perforator gun housing 37, as shown in FIG. 3, because extension portions 70 extend from the perforator gun housing 37 to the perforator portion 36 of the housing 28. Each detonation element 72 of the perforator gun portion 12 has one of the extension portions 70 associated therewith.

The present disclosure is also directed toward a method of performing various oil and gas operations, such as a drilling operation, frac or bridge plug drilling operation, or any other operation in which it is desirable to operate a motor and then operate a TCP perforating gun during one trip into the well in the wellbore by flowing fluid through the downhole tool 10 disclosed herein. Once the oil and gas operations have been completed, fluid can be blocked from passing through the downhole tool 10 and then the perforator gun portion 12 of the downhole tool 10 can be activated creating perforations in a formation that is penetrated by the wellbore. The formation can then be subject to various treatments, such as fracturing operations. The downhole tool 10 can be removed from the wellbore before or after the wellbore is treated.

From the above description, it is clear that the present invention is well adapted to carry out the objectives and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and claimed.

What is claimed is:

1. A downhole tool, the downhole tool comprising:

a perforator gun portion disposed within a housing of the downhole tool for perforating an oil and gas formation;

a bypass passageway for directing fluid past the perforator gun portion in the downhole tool to permit fluid flowing into the downhole tool to flow out of the downhole tool to facilitate an oil and gas operation; and a fluid directing apparatus to divert fluid to the bypass passageway, the fluid directing apparatus includes a radial directed port disposed therein to direct fluid from a passageway disposed in the housing to the bypass passageway.

2. The tool of claim 1 wherein the bypass passageway is an annulus area disposed between the housing of the downhole tool and a perforator gun housing encapsulating a part of the perforator gun portion of the downhole tool.

3. The tool of claim 1 wherein the fluid directing apparatus includes a seat to engage with a fluid blocking element to prevent fluid entering the bypass passageway and cause the perforator gun portion to actuate and perforate the oil and gas formation.

4. The tool of claim 1 wherein the annulus area is unobstructed for the entire length of the perforator gun housing.

5. The tool of claim 1 wherein fluid flowing from the bypass passageway flows into a motor section of the downhole tool, the motor section uses the fluid flowing from the bypass passageway to rotate a passageway housing and a bottom sub of the downhole tool.

6. The tool of claim 5 wherein fluid flowing from the motor section flows into a second annulus area and then flows into a passageway disposed in the passageway housing prior to exiting the downhole tool.

7. A method, the method comprising:

pumping fluid through a downhole tool having a perforator gun portion to perform an oil and gas operation in a wellbore, the downhole tool comprising:

a perforator gun portion disposed within a housing of the downhole tool for perforating an oil and gas formation;

a bypass passageway for directing fluid past the perforator gun portion in the downhole tool to permit fluid flowing into the downhole tool to flow out of the downhole tool to facilitate an oil and gas operation; and a fluid directing apparatus to divert fluid to the bypass passageway, the fluid directing apparatus includes a radial directed port disposed therein to direct fluid from a passageway disposed in the housing to the bypass passageway.

8. The method of claim 7 further comprising the step of blocking the flow of fluid through the downhole tool having the perforator gun portion disposed therein and perforating a formation in the wellbore via the perforator gun portion of the downhole tool.

9. The method of claim 7 wherein the bypass passageway is an annulus area disposed between the housing of the downhole tool and a perforator gun housing encapsulating a part of the perforator gun portion of the downhole tool.

10. The method of claim 7 wherein the fluid directing apparatus includes a seat to engage with a fluid blocking element to prevent fluid entering the bypass passageway and cause the perforator gun portion to actuate and perforate the oil and gas formation.

11. The method of claim 9 wherein the annulus area is unobstructed for the entire length of the perforator gun housing.

12. The method of claim 7 wherein fluid flowing from the bypass passageway flows into a motor section of the downhole tool, the motor section uses the fluid flowing from the bypass passageway to rotate a passageway housing and a bottom sub of the downhole tool.

13. The method of claim 12 wherein fluid flowing from the motor section flows into a second annulus area and then flows into a passageway disposed in the passageway housing prior to exiting the downhole tool.

14. A downhole tool, the downhole tool comprising:

a perforator gun portion disposed within a housing of the downhole tool for perforating an oil and gas formation;

a bypass passageway for directing fluid past the perforator gun portion in the downhole tool to permit fluid flowing into the downhole tool to flow out of the downhole tool to facilitate an oil and gas operation; and a motor section of the downhole tool for receiving fluid flowing from the bypass passageway to rotate a passageway housing and a bottom sub of the downhole tool.

15. The tool of claim 14 wherein fluid flowing from the motor section flows into a second annulus area and then flows into a passageway disposed in the passageway housing prior to exiting the downhole tool.

16. A method, the method comprising:

pumping fluid through a downhole tool having a perforator gun portion to perform an oil and gas operation in a wellbore, the downhole tool comprising:

a perforator gun portion disposed within a housing of the downhole tool for perforating an oil and gas formation;

a bypass passageway for directing fluid past the perforator gun portion in the downhole tool to permit fluid flowing into the downhole tool to flow out of the downhole tool to facilitate an oil and gas operation; and a motor section of the downhole tool for receiving fluid flowing from the bypass passageway to rotate a passageway housing and a bottom sub of the downhole tool.

17. The method of claim 16 wherein fluid flowing from the motor section flows into a second annulus area and then flows into a passageway disposed in the passageway housing prior to exiting the downhole tool.

* * * * *